US005218948A

United States Patent [19]

Mazaki

[11] Patent Number: 5,218,948

[45] Date of Patent: Jun. 15, 1993

[54] INSIDE DIAMETER BLADE

[75] Inventor: Shigeru Mazaki, Urawa, Japan

[73] Assignee: Mitsubishi Kinzoku Kabushiki Kaisha, Japan

[21] Appl. No.: 899,104

[22] Filed: Jun. 15, 1992

Related U.S. Application Data

[63] Continuation of Ser. No. 675,024, Mar. 25, 1992, abandoned, which is a continuation of Ser. No. 321,983, Mar. 10, 1989, abandoned.

[30] Foreign Application Priority Data

Mar. 11, 1988 [JP] Japan ..... 63-32433[U]

[51] Int. Cl.[5] ..... B28D 1/04

[52] U.S. Cl. ..... 125/15; 51/73 R

[58] Field of Search ..... 51/73 R, 206 R, 207, 51/209 R; 125/15

[56] References Cited

U.S. PATENT DOCUMENTS

| | | | |
|---|---|---|---|
| 3,039,235 | 6/1962 | Heinrich | 51/73 R |
| 3,396,714 | 8/1968 | Lauze | 51/73 |
| 3,491,742 | 1/1970 | Weiss | 51/73 |
| 4,228,782 | 10/1980 | Demers et al. | 51/73 R X |
| 4,498,449 | 2/1985 | Kachajian | 125/15 |
| 4,677,963 | 7/1987 | Ajamian | 125/15 |
| 4,850,331 | 7/1989 | Black | 125/15 |

FOREIGN PATENT DOCUMENTS

| | | | |
|---|---|---|---|
| 3300796 | 10/1983 | Fed. Rep. of Germany | 125/15 |
| 3300860 | 11/1983 | Fed. Rep. of Germany | 125/15 |
| 56-4385 | 1/1981 | Japan . | |
| 57-83371 | 5/1982 | Japan . | |
| 58-165965 | 10/1983 | Japan . | |
| 58-165966 | 10/1983 | Japan . | |
| 61-106207 | 5/1986 | Japan . | |
| 61-114813 | 6/1986 | Japan . | |
| 62-139854 | 6/1987 | Japan . | |
| 63-172563 | 11/1988 | Japan . | |

OTHER PUBLICATIONS

"Maraging Steel", Tokushu Seiko Kabushiki Kaisha, FIG 4 (Citing Yates and Hamaker: Metal Progess 82, p. 97 (1962)), 1974.

"Metals Handbook", 8th Edition, vol. 2 Heat Treating, Cleaning and Finishing, pp. 243–253, 255–256, 1964.

"Metal Handbook", 8th Edition, vol. 1 Properties and Selection of Metals, pp. 550–507, 514–517, 1961.

Handbook of Precision Sheet, Strip and Foil, pp. 162–165, Undated.

Steifigkeitsmessung an rotierenden ID-Trennblattern, Industrie-Anzeiger 87/1987.

Schneidbelagtopographie beim Innenlochsagen Industrie-Anzeiger 20/1987.

Japanese Journal "New Diamond" vol. 2, No. 4, published by Kabushiki Kaisha Oma-sha on Nov. 25, 1986.

*Primary Examiner*—Bruce M. Kisliuk
*Assistant Examiner*—John A. Marlott
*Attorney, Agent, or Firm*—Scully, Scott Murphy & Presser

[57] ABSTRACT

An inside diameter blade has an annular plate and a layer of abrasive grains deposited on an internal circumferential portion of the annular plate. The thickness of the internal circumferential portion of the annular plate is set to no greater than 1/5,000 of its outer diameter. The tensile strength of the annular plate is set to no less than 230 kgf/mm$^2$.

4 Claims, 6 Drawing Sheets

2

INSIDE DIAMETER BLADE

This application is a continuation of prior application Ser. No. 675,024, filed Mar. 25, 1992 now abandoned, which is a continuation of prior application Ser. No. 321,983, filed Mar. 10, 1989, now abandoned.

BACKGROUND OF THE INVENTION

1. Field of the Invention

The present invention pertains to an inside diameter blade for cutting ingots of material such as silicon or gallium arsenide.

2. Prior Art

FIGS. 1 and 2 of the accompanying drawings depict a conventional inside diameter blade which comprises an annular stainless steel plate 1 having a cutting edge 2 comprised of a layer of abrasive grains deposited along the internal circumference of the annular stainless steel plate 1. The layer of abrasive grains is comprised of ultrafine abrasive grains of diamond, cubic boron nitride (cBN), or the like dispersed in a plating phase of nickel (Ni), cobalt (Co), or the like. The inside diameter blade is securely fixed at its outer peripheral portion to a drive apparatus so that it can be rotated at high speed. An ingot of silicon or gallium arsenide is inserted through an opening of the inside diameter blade and is cut by the cutting edge 2 into wafers.

The inside diameter blades hitherto used are provided with annular plates 1 of the following nominal outer diameters D and thicknesses T:

TABLE 1

| Nominal outer diameter of annular plate D (inch) | Thickness T (mm) | D/T |
|---|---|---|
| 16 5/8 | 0.10 | 4220 |
| 21 1/2 | 0.12, 0.13 | 4550, 4200 |
| 23 1/2 | 0.13 | 4585 |
| 27 1/6 | 0.15 | 4600 |

When cutting an expensive material such as silicon, the cutting margin must be diminished as much as possible in order to minimize waste of the material to be cut. In order to reduce the cutting margin, the maximum thickness of the layer of abrasive grains in the axial direction of the annular plate 1 should be decreased. However, if only the thickness of the layer of abrasive grains is reduced, the inside diameter blade becomes susceptible to an increased cutting load due to friction between the annular plate 1 and the material to be cut. In addition, chips produced during the cutting operation cannot be smoothly removed. Therefore, the thickness T of the annular plate 1 must as well be reduced.

However, if the thickness T of the annular plate 1 is reduced to less than 1/5,000 of its outer diameter D, the rigidity of the annular plate 1 becomes insufficient, and the internal circumference of the annular plate 1 then tends to vibrate during the cutting operation, thereby resulting in a lowering of the cutting accuracy with such effects as a fluctuation in wafer thickness.

As a possible solution to this problem, an inside diameter blade in which the annular plate has a tensile strength of no less than 180 kgf/mm$^2$ was proposed. With this design, the inside diameter blade is less susceptible to vibration. However, after further investigation, it was realized that another disadvantage arises. Specifically, when the blade of the above construction is used to cut wafers from ingots, the resulting wafers are warped as depicted at $W_1$ in FIG. 3. The wafer $W_1$ thus warped is compressed as shown by the arrows in FIG. 3 in a following lapping process and is lapped as designated by the two dot and dash line. The wafer, however, returns to its warped form when the compressing force is removed after the lapping operation. Thus, warpage of wafers cannot be avoided.

Japanese Patent Application A-Publication Nos. 61-114813 and 61-106207 describe methods of getting rid of the warpage of wafers (FIG. 4). In this method, an end face 4*a* of an ingot 4, from which wafers have been cut, is ground by a face grinding device 5 to obtain a wafer $W_2$ with one planar face 6 as illustrated in FIG. 5. Then, the other face 7 of the wafer $W_2$ is lapped with the planar face 6 resting on a reference face and a wafer without warpage as shown at $W_3$ can thus be obtained.

In the above method, however, the face grinding device 5 must be attached to the slicing machine, and therefore, the slicing machine becomes more intricate in structure. Furthermore, since an additional grinding operation is necessary, the slicing operation is not efficient and the yield of wafers is lowered.

SUMMARY OF THE INVENTION

It is therefore the object of the present invention to provide an inside diameter blade which can not only avoid deviation in the thickness of wafers but also maximize the flatness of wafers.

According to the invention, there is provided an improved inside diameter blade which comprises an annular plate and a layer of abrasive grains deposited along the internal circumferential portion of the annular plate, wherein the thickness of the internal circumferential portion of the annular plate is set to no greater than 1/5,000 of the outer diameter of the annular plate, and wherein the tensile strength of the annular body is set to no less than 230 kgf/mm$^2$.

DESCRIPTION OF THE PREFERRED EMBODIMENTS OF THE INVENTION

Figure 1:
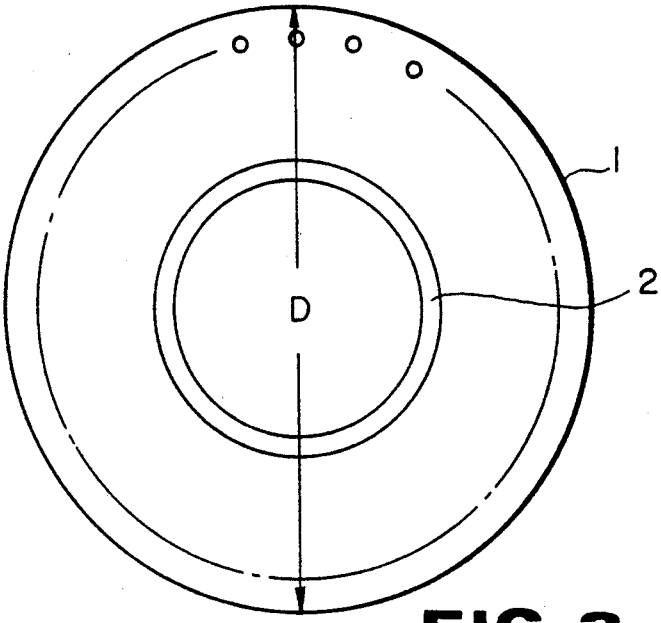
FIG. 1 (PRIOR ART)
FIG. 1 is a front elevation of a conventional inside diameter blade.
Figure 2:
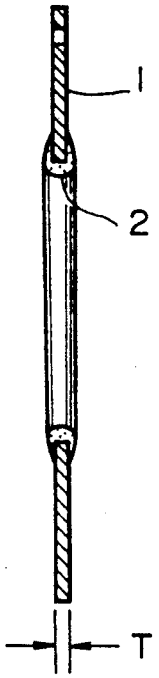
FIG. 2 (PRIOR ART)
FIG. 2 is a cross-sectional view of the blade of FIG. 1.
Figure 3:
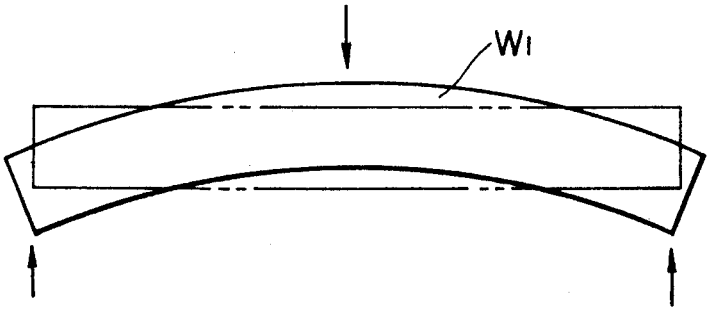
FIG. 3 (PRIOR ART)
FIG. 3 is a schematic side elevation of a wafer cut by the blade of FIG. 1.
Figure 4:
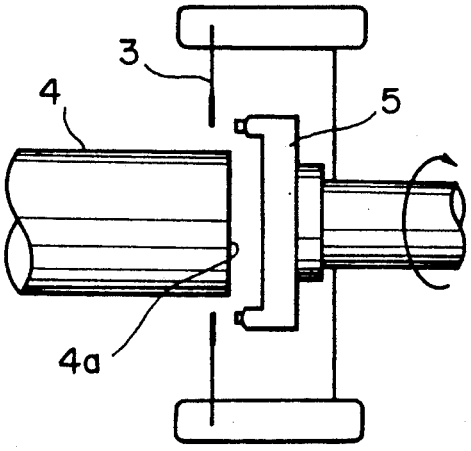
FIG. 4 (PRIOR ART)
FIG. 4 is a schematic view of one conventional slicing machine.
Figure 5:
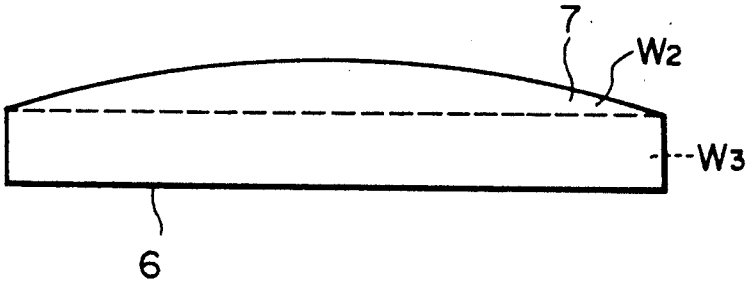
FIG. 5 (PRIOR ART)
FIG. 5 is a schematic side elevation of a wafer cut by the machine of FIG. 4.
Figure 6:
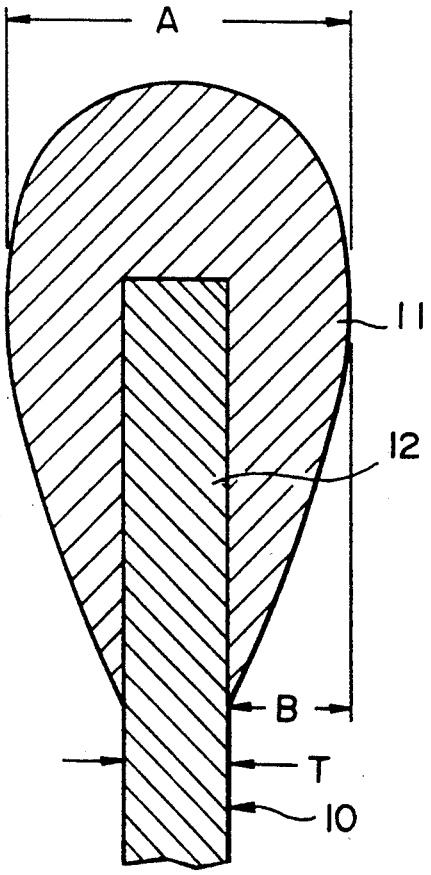
FIG. 6 is a cross-sectional view of a part of an inside diameter blade provided according to the present invention.

FIG. 6 depicts an inside diameter blade in accordance with the present invention. As is the case with the prior art blade, the inside diameter blade is comprised of an annular plate 10 made of stainless steel and having a cutting edge 11 comprised of a layer of abrasive grains formed on an internal circumferential portion 12 of the annular plate 10. The annular plate 10 is so formed that its thickness T is no greater than 1/5,000 of its outer diameter D, and so that it has a tensile strength of no less than 230 kgf/mm$^2$. Stainless steel suitable for the annular plate 10 is PH15-7Mo (AISI 632), 17-7PH, Inconel 750, Maraging Steel, or the like.

In the foregoing, the reason why the annular plate 10 is dimensioned to have a thickness T of no greater than 1/5,000 of its outer diameter D is that if the annular plate 10 is thicker than 1/5,000 of its outer diameter D, the cutting margin cannot be sufficiently reduced. Furthermore, the reason why the tensile strength of the annular plate 10 is set to no smaller than 230 kgf/mm$^2$ is that if it is less than 230 kgf/mm$^2$, the rigidity of the annular plate 10 is inadequate and the inner peripheral portion of the annular plate 10 is susceptible to vibration, thereby lowering the cutting accuracy. Similarly, the flatness of the end face of the ingot will be adversely affected, so that the warpage of the wafers must then be corrected by a face grinding operation.

The layer of abrasive grains is comprised of ultrafine abrasive grains such as diamond and cubic boron nitride dispersed in a plating phase of nickel, cobalt, or the like, and is formed on the internal circumferential portion 12 so as to have a tear drop shaped cross section. The thickness A of the layer of abrasive grains 11 in the axial direction of the annular plate 10 is made comparatively small, and the relief length B defined as the distance between the annular plate 10 and the maximum height of the cutting face of the layer 11 is made comparatively large.

The inside diameter blade of the above construction has the following advantages:

As is the case with the previously proposed blade, the vibration of the internal circumferential portion can be minimized since the tensile strength of the annular plate 10 is great. Therefore, the deviation in the thickness of wafers can be avoided and thereby the cutting accuracy is improved. In addition, inasmuch as the tensile strength of the annular plate 10 is specifically set to no smaller than 230 kgf/mm$^2$, the end face of the ingot can always be formed adequately flat, and hence, no additional device or process is required to manufacture wafers without warpage.

In the foregoing, the inside diameter blade is used to cut ingots of semiconductor material, but may be used to cut other material than the semiconductor ingots.

The present invention will now be illustrated by the following examples:

EXAMPLE 1

There were prepared an inside diameter blade in accordance with the present invention and a conventional inside diameter blade for comparison purposes. The blades were constructed as follows.

INSIDE DIAMETER BLADE OF THE INVENTION

Outer diameter of annular plate D: 23.5 inch (596 mm)
Inner diameter: 203.8 mm
Thickness of annular plate T: 0.10 mm, D/T: 5960
Material of annular plate: very high tensile alloy
Tensile strength of annular plate: 240 kgf/mm$^2$
Thickness of layer of abrasive grains: 0.27 mm.

CONVENTIONAL INSIDE DIAMETER BLADE (COMPARATIVE BLADE 1)

Outer diameter of annular plate D: 23.5 inch (596 mm)
Inner diameter: 203.8 mm
Thickness of annular plate T: 0.13 mm, D/T: 4584
Material of annular plate: Stainless steel (SUS301)
Tensile strength of annular plate: 184 kgf/mm$^2$
Thickness of layer of abrasive grains: 0.30 mm, In the foregoing, for measuring the tensile strength, test pieces were prepared according to JIS (Japanese Industrial Standard) 13B testing, and "AutoGraph AG-5000A" made by Kabushiki Kaisha Shimazu Seisakusho was used to measure the strength under a cross head speed of 0.5 mm/minute.

Then, both the inside diameter blades were subjected to a cutting test under the following conditions:
Radial expansion of annular plate: 1,200 μm
Peripheral speed of annular plate: 1,100 m/minute
Infeed rate: 60 mm/minute
Coolant: city water (8 l/hour)
Material to be cut: Silicon ingots of 5 inch in diameter
Slicing machine: "MS27B" made by Mitsubishi Metal Corp.

The results are set forth in FIGS. 7 to 10 of the accompanying drawings.

Figure 7:
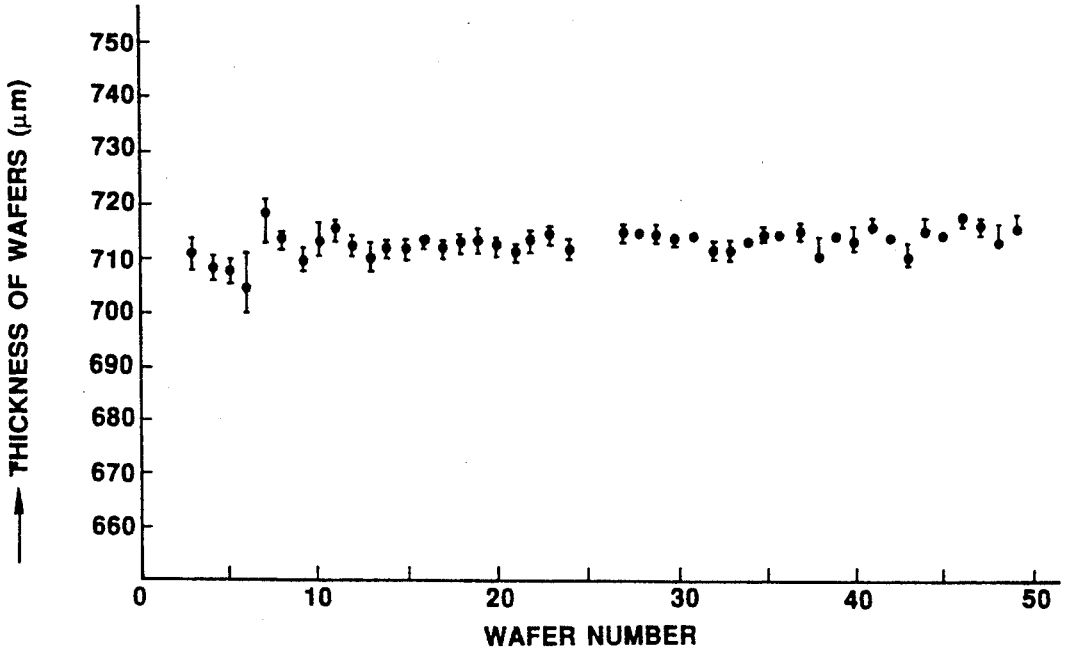
FIGS. 7 to 10, 12 and 13 are graphs showing the results of experiments carried out to show the advantages of the invention.
Figure 8:
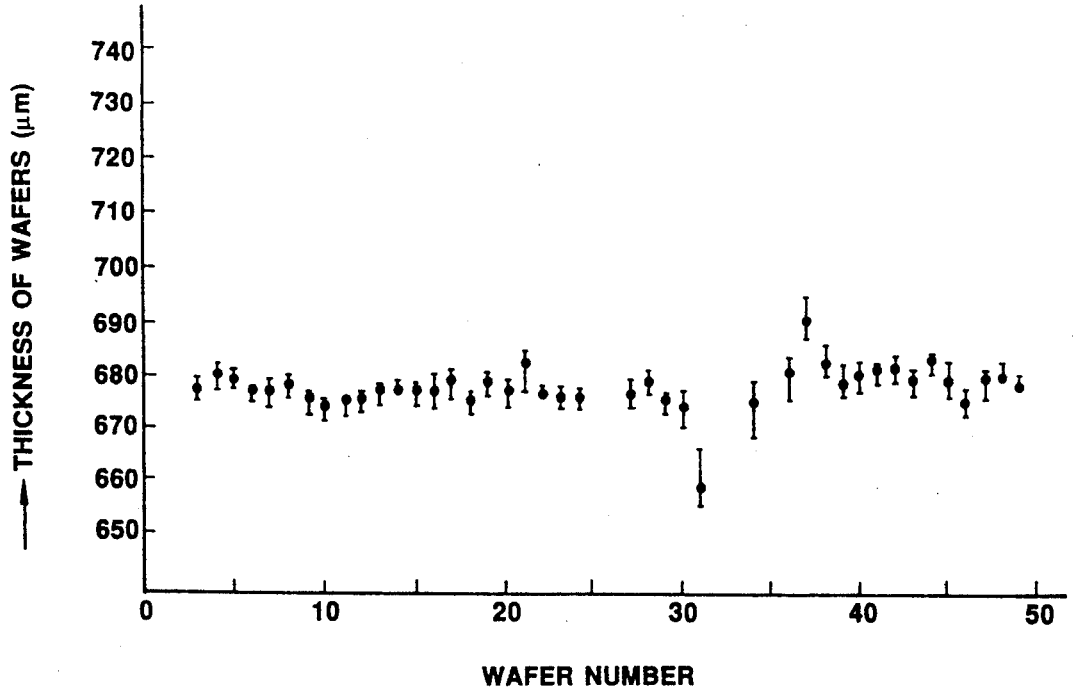

FIG. 7 illustrates the variation in the thickness of wafers sliced by the inside diameter blade of the invention, while FIG. 8 illustrates the same for wafers sliced by the conventional inside diameter blade. As is seen from these results, the variation in thickness of wafers cut by the inside diameter blade of the invention is reduced as compared with that of wafers cut by the conventional blade. In fact, in regard to the wafers cut by the inside diameter blade of the invention, the five-point average of the thickness was 712.68 μm, and the standard deviation for the variation in thickness of wafers was 1.87 μm. In contrast, the wafers cut by the conventional blade had an average thickness of 677.12 μm, and the standard deviation of the thickness variation was 2.01 μm.

Figure 11A:
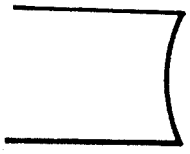
FIGS. 11(*a*) and 11(*b*) are schematic views showing bow on the ingot.
Figure 11B:
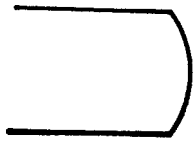
Figure 9:
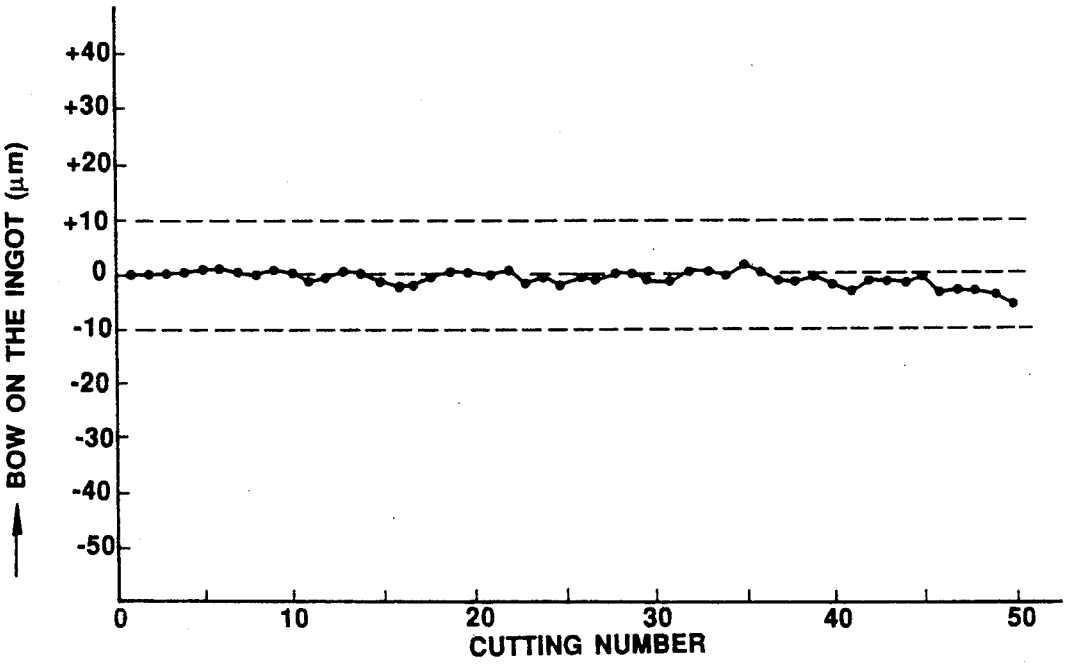
Figure 10:
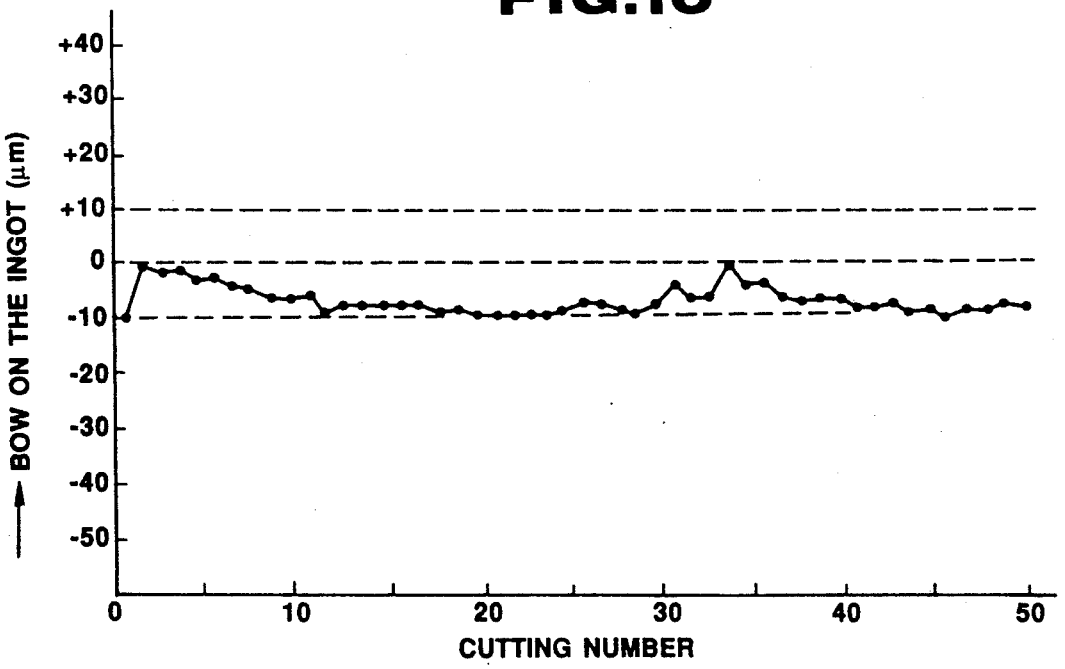

Furthermore, FIG. 9 illustrates the bow on the ingot cut by the inside diameter blade of the invention, while FIG. 10 illustrates that on the ingot cut by the conventional blade. In these results, bow which takes minus value is defined as warpage shown in FIG. 11(*a*) while the bow which takes plus value is defined as that shown in FIG. 11(*b*). As is seen from these results, the end face of the ingot cut by the inside diameter blade of the invention is flatter than that of the ingot cut by the conventional blade.

EXAMPLE 2

There was prepared another inside diameter blade (comparative blade 2) of the following construction:
Outer diameter of annular plate D: 23.5 inch (596 mm)
Inner diameter: 203.8 mm
Thickness of annular plate T: 0.10 mm, D/T: 5960
Material of annular plate: very high tensile alloy
Tensile strength of annular plate: 220 kgf/mm$^2$
Thickness of layer of abrasive grains: 0.27 mm.

Then, the inside diameter blade was subjected to the cutting test under the same conditions as in Example 1. The results are set forth in FIGS. 12 and 13.

Figure 12:
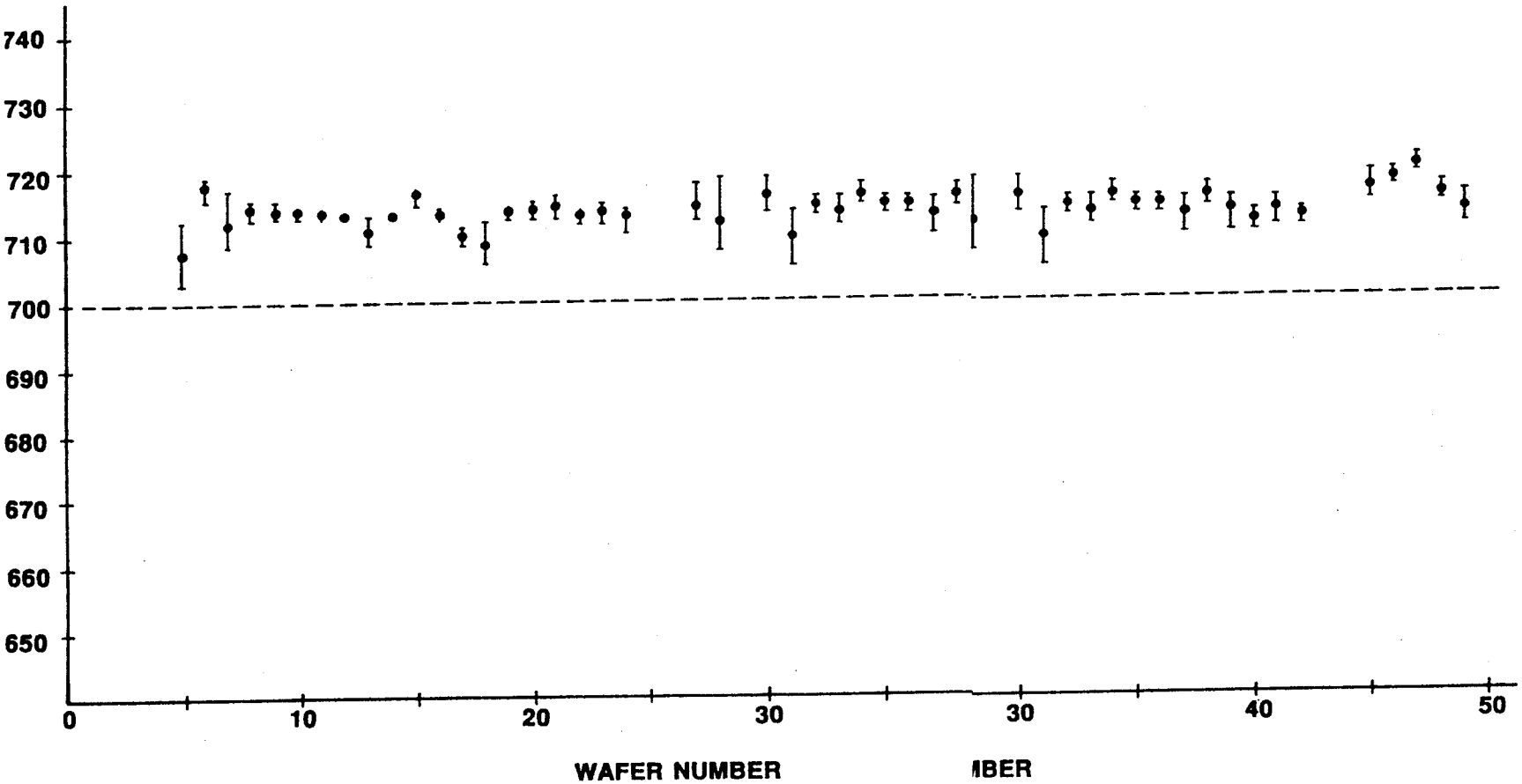
Figure 13:
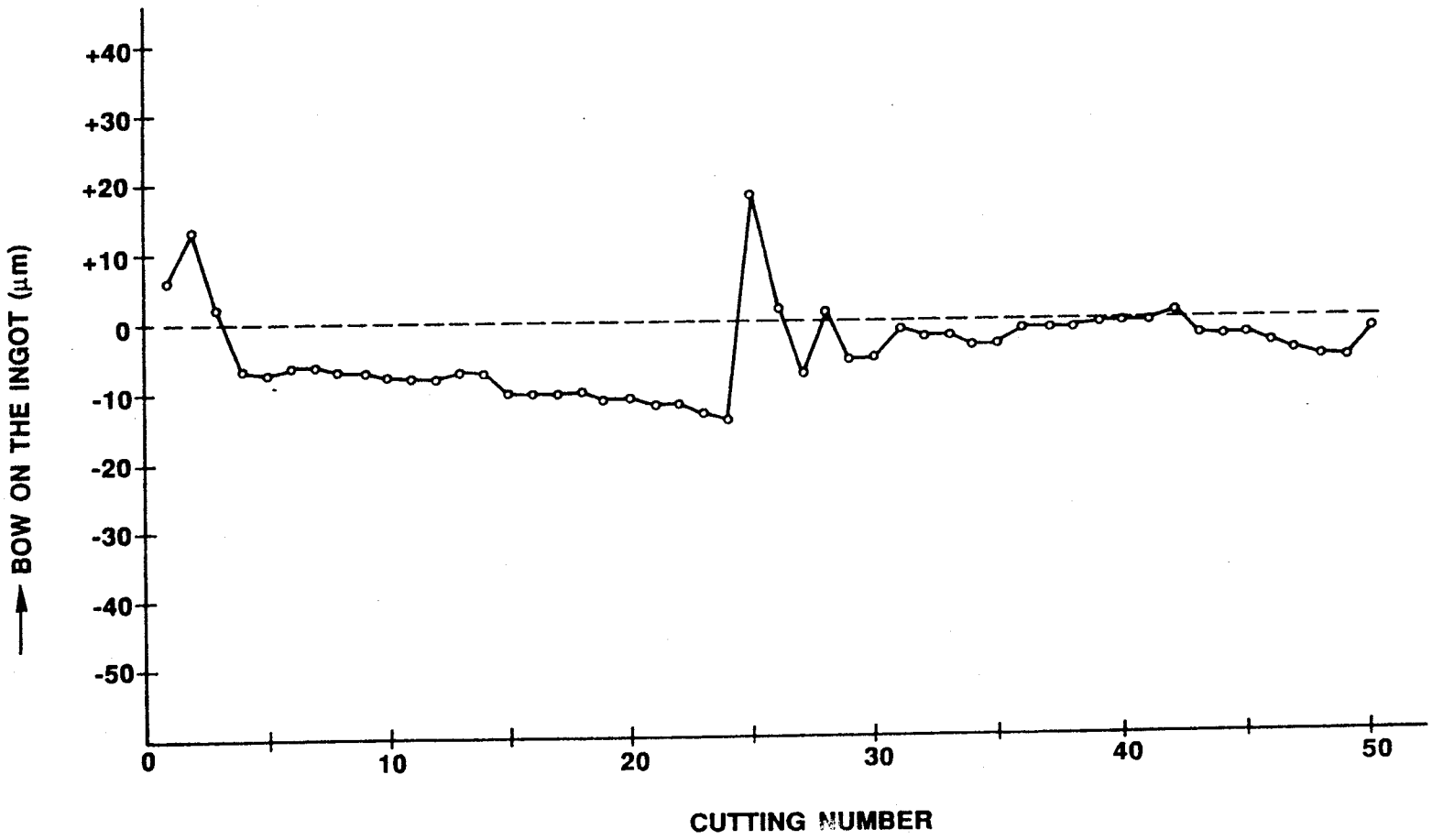

When the results are compared with those obtained for the blade of the invention of Example 1, it can be seen from FIGS. 7 and 12 that, the inside diameter blade of the invention exhibits superior cutting accuracy as compared with the comparative blade. In fact, the wafers cut by the comparative blade had an average thickness of 714.03 μm, and the standard deviation of the thickness variation was 2.50 μm. Furthermore, it can also be seen from FIGS. 9 and 13 that the inside diameter blade of the invention achieves superior flatness of wafers.

What is claimed is:

1. An inside diameter blade which comprises an annular plate and a layer of abrasive grains formed on an internal circumferential portion of said annular plate, wherein the thickness of said inner peripheral portion of said annular plate is set to no greater than 1/5,000 of the outer diameter of said annular plate, and wherein the tensile strength of said annular plate is approximately 240 kgf/mm$^2$.

2. An inside diameter blade according to claim 1, wherein said annular plate is made of high tensile strength stainless steel.

3. An inside diameter blade according to claim 2, wherein said abrasive grains are ultrafine abrasive grains of a material selected from the group consisting of diamond and cubic boron nitride.

4. An inside diameter blade according to claim 1, wherein the tensile strength of said annular plate is substantially 240 kgf/mm$^2$.

* * * * *